US006426858B1

(12) United States Patent
Schroeder

(10) Patent No.: US 6,426,858 B1
(45) Date of Patent: Jul. 30, 2002

(54) VOLTAGE CONDITIONER AND SWITCHING DEVICE

(75) Inventor: Fritz Schroeder, Gardnerville, NV (US)

(73) Assignee: OEM Products, LC, Gardnerville, NV (US)

( * ) Notice: Subject to any disclaimer, the term of this patent is extended or adjusted under 35 U.S.C. 154(b) by 0 days.

(21) Appl. No.: 09/547,962

(22) Filed: Apr. 12, 2000

(51) Int. Cl.[7] ..... H01H 47/00
(52) U.S. Cl. ..... 361/166; 307/115; 307/132 E
(58) Field of Search ..... 361/2, 3, 160, 361/166, 167; 307/115, 132 E, 98, 99, 104, 125, 128, 130, 132 M, 140

(56) References Cited

U.S. PATENT DOCUMENTS

| | | | | |
|---|---|---|---|---|
| 4,389,691 | A | 6/1983 | Hancock | 361/8 |
| 5,267,120 | A | 11/1993 | Graff et al. | 361/185 |
| 5,283,706 | A | 2/1994 | Lillemo et al. | 361/3 |
| 5,528,120 | A | 6/1996 | Brodetsky | 318/785 |
| 5,633,540 | A | 5/1997 | Moan | 307/126 |
| 5,905,422 | A | 5/1999 | Doneghue | 335/78 |

*Primary Examiner*—Ronald W. Leja
(74) *Attorney, Agent, or Firm*—Sierra Patent Group, Ltd.

(57) ABSTRACT

The present invention is a voltage conditioner and switching device applied to alternating current relays. An electronic circuit and direct current (DC) relay to overcome material, mechanical, physical, and construction variations of electromechanical alternating current (AC) relays is disclosed.

7 Claims, 4 Drawing Sheets

VOLTAGE CONDITIONER AND SWITCHING DEVICE

BACKGROUND OF THE INVENTION

1. Field of the Invention

Figure 1A:
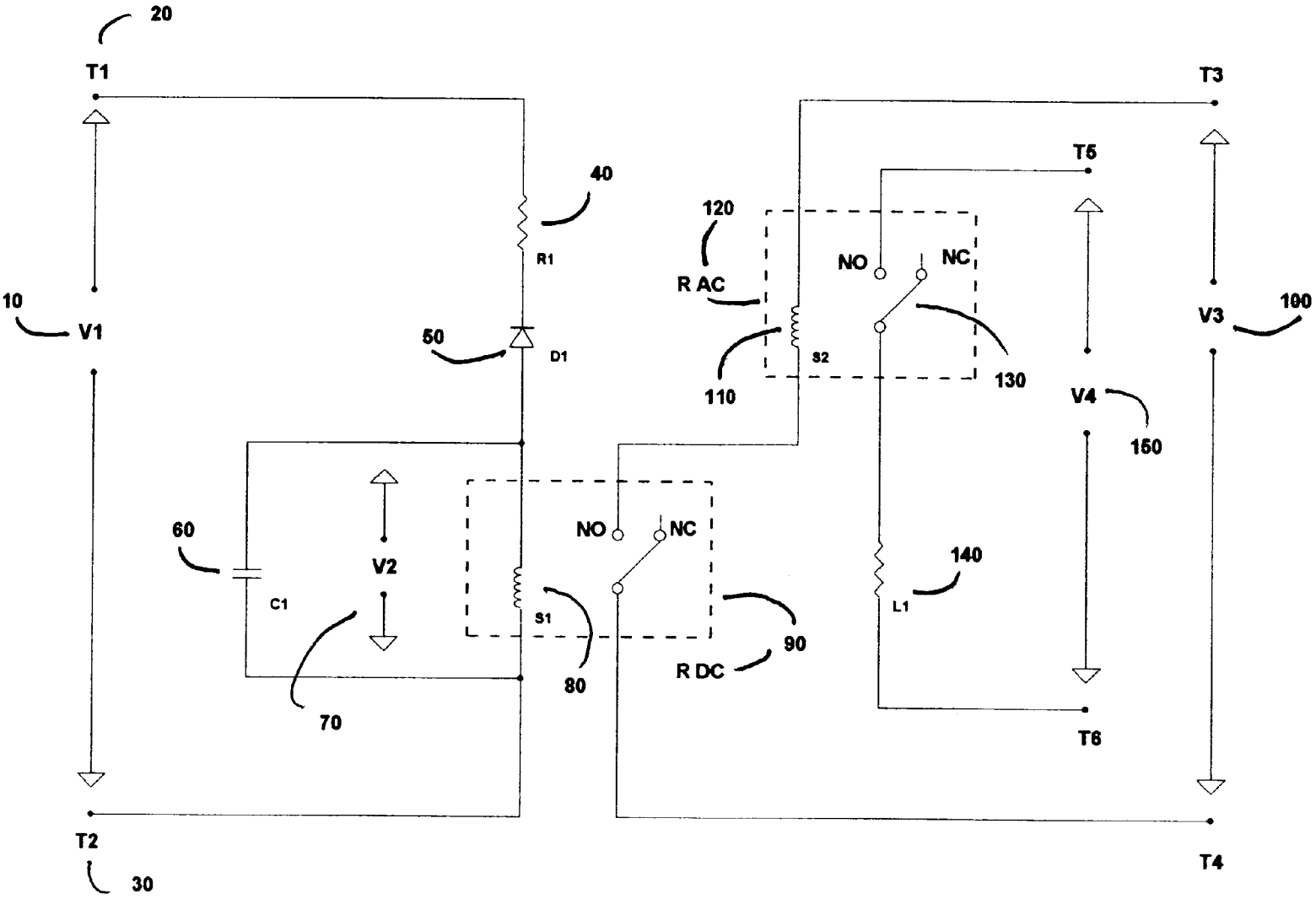

This invention relates generally to a circuit and apparatus for switching an alternating current (AC) relay at predetermined voltage levels with assured repeatability and precision.

2. The Prior Art

Electromechanical relays with solenoid coils are characterized by a pickup voltage, the voltage at which the solenoid pulls in and energizes the contacts, and a dropout voltage at which the solenoid drops out and de-energizes the contacts. The pickup and dropout voltage for alternating current (AC) relays varies significantly from relay to relay when made by the same manufacturer with even greater differences for relays made by different manufacturers. These differences are due to limitations of control over materials, the size of the relays and assembly techniques.

These limitations are minimal and electrically controllable for direct current (DC) relays. Direct current relays, however, are limited in general applications and cannot be substituted for alternating current relay applications. This invention exploits the controllability and precision of direct current relays and amplifies and transfers the qualities to alternating current relays.

There are several patents that disclose various apparatus and methods for controlling relays.

Graff et al. U.S. Pat. No. 5,267,120 discloses a device whereby a micro-controller measures and then adjusts a time delay in order for the contacts to make at a predetermined point on a sinusoidal waveform.

Hancock, U.S. Pat. No. 4,389,691 discloses an arc suppression device for protecting contacts against excessive wear due to arcing.

Doneghue, U.S. Pat. No. 5,905,422 discloses mechanical means for adjusting the travel distance of the armature of an electromechanical relay to meet the response time parameters.

Brodetsky, U.S. Pat. No. 5,528,120 discloses a field adjustable electronic potential relay for a starting circuit for single-phase motors.

Moan, U.S. Pat. No. 5,633,540 discloses a surge resistant relay switching circuit where the electromechanical relay contacts are protected from inrush currents by placing a TRIAC in series with the switching contacts which blocks current flow until after the contacts are closed.

Lillemo et al, U.S. Pat. No. 5,283,706 discloses a switching circuit whereby a solid state switch forces contacts of an electromechanical relay to open or close at the moment the sine wave crosses at zero in order to prevent arcing and overheating of the contacts.

It therefore is an object of the present invention to provide a device for energizing or de-energizing any alternating current relay at precise pre-determined voltage levels.

It is another object of this invention to provide a device for energizing or de-energizing a solid state switching device capable of switching a current and/or voltage load larger than the current and/or voltage capabilities of the direct current relay contacts.

BRIEF DESCRIPTION OF THE INVENTION

The present invention is a voltage conditioner and switching device applied to alternating current relays. The present invention is distinguished over the prior art in general and these patents in particular by a simple rectifier circuit which by fixed resistor selection and capacitor filtering determine the precise energizing voltage of a direct current relay. The direct current relay contacts can then energize or de-energize an alternating current relay at consistently the same voltage level regardless of manufacturing material or assembly technique differences. A solid state switching device such as a MOSFET, TRIAC, SCR or other device may be triggered by the direct current relay if the alternating current relay solenoid amperage and/or voltage requirements exceed the direct current relay contact ratings.

BRIEF DESCRIPTION OF THE DRAWING FIGURES

FIG. 1A, FIG. 1B, FIG. 2 and FIG. 3 are schematic diagrams of embodiments of the present invention.

DETAILED DESCRIPTION OF THE INVENTION

Those of ordinary skill in the art will realize that the following description of the present invention is illustrative only and not in any way limiting. Other embodiments of the invention will readily suggest themselves to such skilled persons.

Referring to FIG. 1A, a schematic diagram of an illustrative first embodiment of the present invention is shown. When alternating current (AC) voltage 10 is applied at terminals 20 and 30, AC current passes through resistor 40 and is converted to half-wave-rectified direct current (DC) after passing through diode 50. Capacitor 60 minimizes the ripple of the half-wave-rectified direct current and applies a DC voltage (indicated by the arrow at reference numeral 70) to the solenoid 80 of direct current relay 90. If AC voltage 10 increases, the solenoid voltage 70 increases proportionately and when AC voltage 10 reaches a predetermined high voltage level, then the solenoid DC voltage 70 will energize and close the normally-open (NO) set of contacts. This applies AC energizing voltage 100 to the solenoid 110 of AC relay 120 through the closed contacts and closes the normally-open set of contacts 130. Load 140 is therefore connected to voltage 150 at a precise voltage level at terminals 20 and 30 as the voltage is increasing.

Figure 1B:
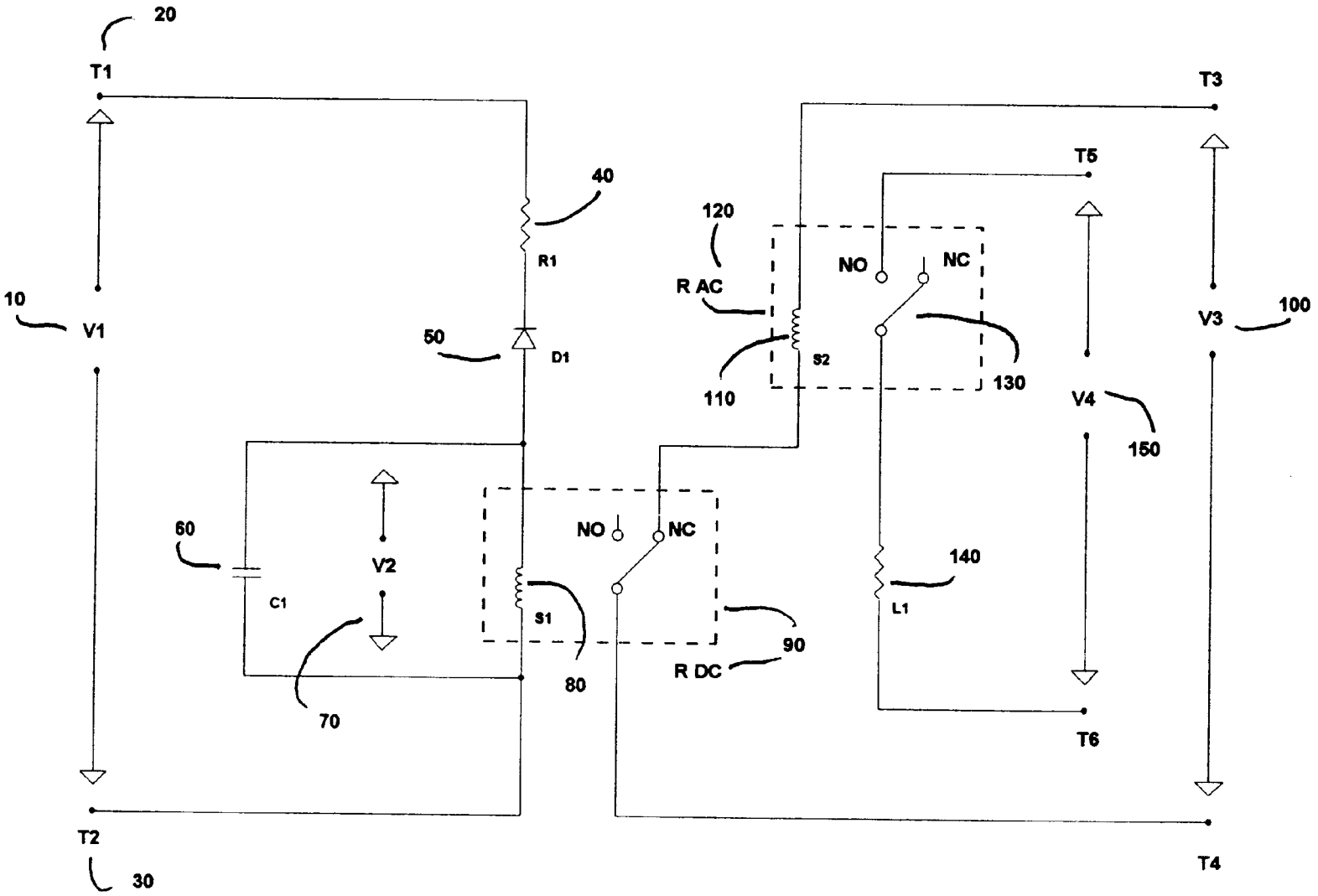

Referring to FIG. 1B, it should be understood that if solenoid 110 of AC relay 120 is connected to the normally closed (NC) set of contacts of DC relay 90 which energizes solenoid 110 of AC relay 120, then the load 140 is disconnected from voltage 150 at a precise high voltage level at terminals 20 and 30 as the voltage is increasing.

It should be further understood, referring to FIG. 1A, that when AC voltage 10 is applied and relay RDC is immediately energized, then resistor 40 can be selected such that as the AC voltage 10 is decreasing, the solenoid voltage decreases proportionately and AC voltage 10 reaches a predetermined low voltage level, then the solenoid DC voltage 70 will de-energize and open the normally open set of contacts. This disconnects AC energizing voltage 100 to the solenoid 110 of AC relay 120 and opens the contacts 130. Load 140 is therefore disconnected to voltage 150 at a precise decreasing voltage level at terminals 20 and 30.

It should also be understood, referring to FIG. 1B, that if solenoid 110 of AC relay 120 is connected to the normally closed (NC) contact of DC relay 90 which energizes solenoid 110 of AC relay 120, then the load 140 is connected to voltage 150 at a precise high voltage level at terminals 20 and 30 as the voltage is decreasing.

In summary, the invention will energize or de-energize a load at a precise voltage as the voltage increases and will energize or de-energize a load at a precise voltage as the voltage decrease. The precise AC voltage 10 at terminals 20 and 30, which energizes DC relay 90 can be altered by the selection of the resistance value of resistor 40.

Voltage 10 can be in the range between 110V and 460V. Solenoid 80 is rated for 48V DC and therefore, a "Voltage Drop" resistor 40 is required. For example, if Voltage 10 is 110V, then resistor 40 may have a value of 12 k ohms to drop voltage 70 to 48V. The diode 50 half-wave-rectifies the AC voltage to DC voltage and the capacitor 60 acts as a filter to smooth a "pulsating" DC voltage. The value of capacitor 60 could be from 2 microfarads (MFD) to 100 MFD depending on how much filtering (smoothing) is required depending on the selection of RDC.

Figure 2:
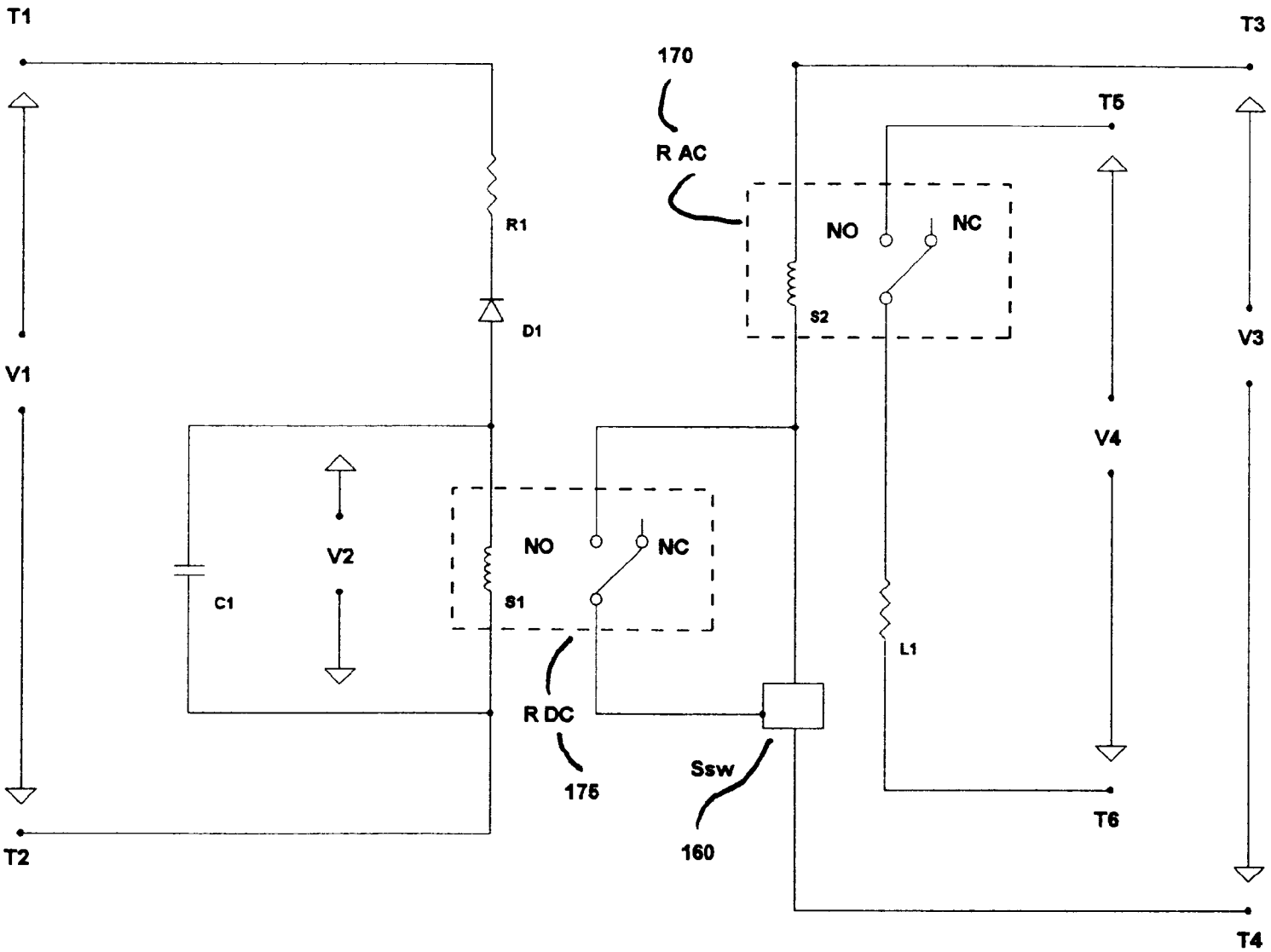

Referring to FIG. 2, a schematic diagram of an illustrative second embodiment is show. The function of this embodiment is the same as in FIG. 1, except that a solid state switching device 160 such as a MOSFET, TRIAC, SCR is triggered to conduct current and energize AC relay 170 when the solenoid voltage and/or current requirements are not compatible with the contact ratings of DC relay 175.

Figure 3:
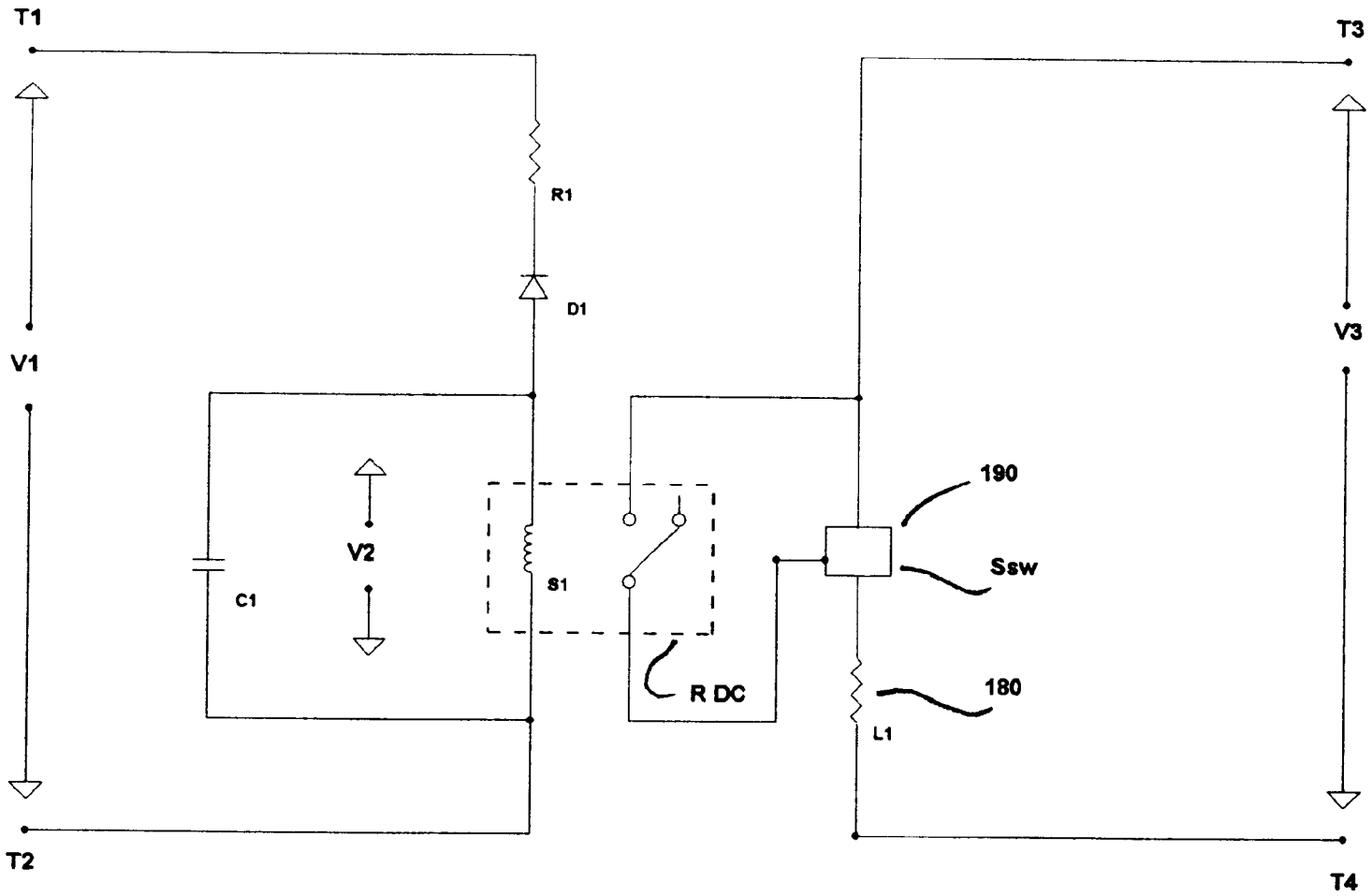

Referring to FIG. 3, a schematic diagram of an illustrative third embodiment is shown. The function of this embodiment is the same as in FIG. 2, except that the load 180 may be switched directly with solid state switch 190 if that design is preferred.

A typical application would see the device for instance connected between the 110V plug and a computer. Referring to FIG. 1, resistor 40 is selected such that if the voltage at the plug goes above 125V, the computer is disconnected and a warning device is turned on. Voltage 100 could be again 110V to 460V depending on application and the warning device, (Load 140 e.g., a light bulb, buzzer, telephone dialer) may only be 12V or 24V or 460V (Voltage 150). The invention is flexible in application because it could be used to start the same chain of events if the voltage 10 went below for example 90V. In short, the invention can be used to sense many different voltages 10 over or under, and can turn on or off many different voltages 100 and 150 depending on the selection of resistor 40 and connections to the contacts of the DC relay 90 or the AC relay 120.

It will be appreciated by those skilled in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range and equivalence thereof are intended to be embraced therein.

What is claimed is:

1. A method for switching an alternating current relay at a predetermined voltage level comprising:

applying an alternating voltage across two terminals;

passing current from said alternating voltage through a resistor and rectifying said alternating current to direct current by passing said current through a diode;

minimizing the ripple of said direct current and applying a voltage established thereby to a first solenoid, said first solenoid energizing at a predetermined voltage level and closing a first set of contacts;

energizing a second solenoid through said first set of contacts to close a second set of contacts.

2. The method according to claim 1, wherein energizing said second solenoid through said first set of contacts further comprises activating a solid state switch through said first set of contacts to energize said second solenoid.

3. The method according to claim 1 further comprising;

triggering a solid state switching device to conduct current to energize said second solenoid to close said second set of contacts.

4. A circuit for switching an alternating current relay at predetermined voltage levels comprising:

a DC relay having a set of normally-open contacts;

means for causing said DC relay to energize at a preselected AC input voltage; and an AC relay having a set of switch contacts coupled to an AC voltage source through said set of normally-open contacts of said DC relay, said AC relay having a solenoid coupled to said AC voltage source through said set of normally-open contacts of said DC relay.

5. The circuit according to claim 4 wherein said solenoid of said AC relay is coupled to said AC voltage source through a solid state switch.

6. A circuit for switching an alternating current relay at predetermined voltage levels comprising:

a first and second AC voltage input terminal;

a DC relay having a DC coil and a normally open set of contacts;

said DC coil having a first end connected to said first AC voltage input terminal and a second end;

a capacitor connected in parallel with said DC coil;

a resistor and a diode connected in series between said second AC voltage input terminal and said second end of said DC coil;

third and fourth AC voltage input terminals;

an AC relay connected in series with said normally opened set of contacts between said third and fourth AC voltage input terminals, said AC relay having at least one set of contacts, said resistor, capacitor and DC relay selected to operate said AC relay at a predetermined voltage.

7. A control circuit comprising:

an alternating current input signal source, said alternating current input signal source varying in root mean square and amplitude;

a rectifier circuit coupled to said alternating current input signal source, said rectifier circuit having a direct current output varying proportionately with said varying alternating current input signal source;

a direct current relay including a coil and a set of normally open contacts; said direct current relay coil coupled to said rectifier circuit direct current output; said coil selected to energize at a predetermined direct current voltage; and an alternating current relay operatively coupled to said set of normally open contacts of said direct current relay, said alternating current relay having a coil, wherein said normally open contacts close to energize said coil of said alternating current relay.

* * * * *